US008323164B2

(12) United States Patent
Messerschmid

(10) Patent No.: US 8,323,164 B2
(45) Date of Patent: Dec. 4, 2012

(54) DEVICE AND A PROCESS FOR THE PRODUCTION OF SLEEVES

(75) Inventor: Uwe Messerschmid, Albershausen (DE)

(73) Assignee: Michael Hoerauf Maschinenfabrik GmbH & Co. KG, Donzdorf (DE)

( * ) Notice: Subject to any disclaimer, the term of this patent is extended or adjusted under 35 U.S.C. 154(b) by 393 days.

(21) Appl. No.: 12/653,441

(22) Filed: Dec. 14, 2009

(65) Prior Publication Data

US 2010/0160130 A1 Jun. 24, 2010

(30) Foreign Application Priority Data

Dec. 22, 2008 (DE) ..... 10 2008 064 503
Jun. 26, 2009 (DE) ..... 10 2009 031 691

(51) Int. Cl.
*B31B 43/00* (2006.01)

(52) U.S. Cl. ..... 493/154; 493/106; 493/137

(58) Field of Classification Search ..... 493/106–108, 493/137, 140, 144, 154
See application file for complete search history.

(56) References Cited

U.S. PATENT DOCUMENTS 1,766,226 A * 6/1930 Nias et al. ..... 229/5.5
2,642,784 A * 6/1953 Wittkuhns et al. ..... 493/106
3,065,678 A * 11/1962 Armstrong ..... 493/105
3,418,894 A * 12/1968 Jivoin ..... 493/309
4,605,391 A * 8/1986 Cook ..... 493/159
7,481,356 B2 * 1/2009 Stahlecker ..... 229/403
7,905,821 B2 * 3/2011 Stahlecker ..... 493/152
8,146,796 B2 * 4/2012 D'Amato ..... 206/505
2006/0186012 A1 * 8/2006 D'Amato ..... 206/505
2006/0226210 A1 * 10/2006 Stahlecker ..... 229/403
2006/0237465 A1 * 10/2006 D'Amato ..... 220/592.27
2008/0029588 A1 * 2/2008 Messerschmid et al. ..... 229/400

FOREIGN PATENT DOCUMENTS

EP 1 227 043 A1 7/2002
JP 2006290463 A * 10/2006

* cited by examiner

*Primary Examiner* — Hemant M Desai

(74) *Attorney, Agent, or Firm* — Flynn, Thiel, Boutell & Tanis, P.C.

(57) ABSTRACT

The invention relates to a device and a process for manufacturing sleeves, in particular paper sleeves for the production of paper cups, comprising a take-up mandrel for taking up a sleeve, whereby the take-up mandrel comprises a circumferential recess, also comprising a press roller for placing on an outer side of the sleeve and for forming at least one circumferential projection in the recess of the take-up mandrel. In accordance with the present invention, the recess is designed in the form of a shoulder.

Application for example for the production of stackable double-walled paper cups.

9 Claims, 2 Drawing Sheets

DEVICE AND A PROCESS FOR THE PRODUCTION OF SLEEVES

FIELD OF THE INVENTION

The present invention relates to a device and a process for the production of sleeves, in particular paper sleeves for the production of paper cups.

BACKGROUND OF THE INVENTION

Paper cups as described for example in the European patent application EP 1 227 043 A1 are used for serving beverages, and are also available with a double-walled design for holding hot beverages. The insulating properties of such double-walled paper cups are satisfactory. Problems may arise however in the case of such double-walled paper cups when a large number of paper cups must be stacked together. When a large number of cups are stacked, the lower cups may become jammed, so that the cups can only be separated from one another with difficulty or not at all. Beads can be provided on the inner cup as an aid against jamming, on which beads the respective top cup can be supported. This measure prevents the cups from jamming. Circumferential projections of this type in the form of circumferential beads are pressed into the cup sleeve by means of a press roller. A cup of this type is disclosed for example in the European patent application EP 1 227 043 A1. The pressing in of such a bead results in a stretching of the material in the area of the bead. As paper cannot really be stretched, there is a risk that the inner sleeve can tear in the area of the bead. In order to avoid tearing in the inner sleeve, the bead is, as a rule, only lightly pressed in.

SUMMARY OF THE INVENTION

It is an object of the present invention to provide a device and a process for the production of sleeves in which the risk of tearing in the cup sleeve when a circumferential projection is being formed is reduced.

In accordance with the present invention, a device and a process for manufacturing sleeves are provided, in particular for paper sleeves for the production of paper cups, comprising a take-up mandrel for taking up a sleeve, whereby the take-up mandrel comprises a circumferential recess, also comprising a press roller for placing on an outer side of the sleeve and for forming a circumferential projection in the recess of the take-up mandrel, wherein the recess is designed in the form of a shoulder.

As a result of these measures, a circumferential projection, projecting in the direction towards the inner space of the sleeve, can be executed essentially without any material stretching of the sleeve occurring, due to the design of the recess in the form of a shoulder which permits the material of the sleeve to be folded into the recess, said material yielding to the folding movement, or be drawn into the recess by the press roller. As a result the sleeve material itself is stretched either only insignificantly or not at all, while in the case of paper sleeves, no weakening of the paper material occurs, but rather a stabilisation of the paper material is achieved by means of a compression in the area of the circumferential projection. By means of the device according to the present invention, circumferential projections can be formed in paper sleeves, said projections projecting sufficiently into the inner space of the sleeve to permit a reliable stacking of a number of cups. The recess begins in the outer surface of the take-up mandrel, said outer surface being located in an imaginary and in particular, conical base area of the take-up mandrel, in the direction towards the centre longitudinal axis of the take-up mandrel. The recess is in the form of a shoulder or a step and comprises a shoulder face starting from a point on the outer surface located in the imaginary base area. Directly adjoining the shoulder face is a shoulder area, which again extends towards a further outer surface of the take-up mandrel, which also is located in the imaginary base area.

In a further embodiment of the invention, the shoulder face forms an angle between 45° and 90° with the middle longitudinal axis, and the shoulder area extends parallel to the middle longitudinal axis or forms an angle therewith of less than 20°.

In this way a stable projection, well suited for the purposes of stacking, is created by means of a steep shoulder face, which can be arranged almost at right angles to the outer surface of the take-up mandrel. At the same time, the lowest possible material load is achieved by means of a flat angle at the shoulder area, as the shoulder area forms an angle of less than 45° with the imaginary base area of the take-up mandrel, in which its outer surfaces are located. The shoulder area extends advantageously parallel to the middle longitudinal axis of the cup in order to be able to reliably transfer stacking forces.

In a further embodiment of the present invention, the take-up mandrel comprises a conical base form, whereby the shoulder surface extends beginning at the shoulder face in the direction towards the thinner end of the take-up mandrel.

Despite the conical base form of the take-up mandrel, a yielding or a drawing in of the sleeve material from the thick end of the take-up mandrel is permitted. Due to the particular design of the recess in the form of a shoulder, no additional material is needed from the thin side of the take-up mandrel, as the material in this case is just folded in. Conical cup sleeves already provided with bottom and lip can as a result be provided with a circumferential projection. As a result of the forming of the projection and the drawing in of the sleeve material into the shoulder-shaped recess, the overall height of the cup is only minimally reduced.

In a further embodiment of the present invention the take-up mandrel comprises at least one further recess. The second recess is at a distance to the circumferential recess which serves the formation of a circumferential projection in the cup sleeve. In relation to the shoulder of the circumferential recess, the second recess is arranged in the area of the thicker end of the take-up mandrel.

The second recess, which is arranged above the recess in the form of a shoulder, permits the sleeve material to yield from the thicker end of the take-up mandrel in the direction of the shoulder in an improved way. In providing a second recess, the adherence of the sleeve material on the take-up mandrel is lessened, as the contact surface between the take-up mandrel and the sleeve is reduced.

In an improved embodiment, a second recess in the form of a groove-like recess in in the conical outer surface of the take-up mandrel. The groove-like recess extends advantageously essentially parallel to the middle longitudinal axis of the take-up mandrel. A number of grooves are advantageously arranged along the circumference of the take-up mandrel. A part of the conical outer surface remains between the respective grooves. This embodiment has the advantage in that the contact surface between the take-up mandrel and the sleeve material is reduced and thus the adherence of the sleeve material is lessened, while at the same time an optimum guiding of the sleeve material is ensured by means of the areas remaining between the grooves.

In a further embodiment of the present invention, the press roller comprises a circumferential shoulder, which is adapted to the recess of the take-up mandrel.

As a result, a large area of sleeve material can be pressed into the recess, so that the pressing force acting on the sleeve material is high collectively, but is low per unit area. In this way, damage to the paper material or a layer of the paper material during forming of the circumferential shoulder is avoided.

A further object of the present invention has been solved in a process for the production of a paper cup with the following steps:

Forming of a cup sleeve, take-up of the cup sleeve onto an outer surface of a take-up mandrel, whereby the take-up mandrel is provided with a recess for forming a circumferential projection in the cup sleeve, application of a press roller to the cup sleeve outside of the recess, forming of the projection extending into the recess of the take-up mandrel by means of the press roller, whereby during forming of the projection, the press roller draws in a part of the material of the cup sleeve from the outer surface of the take-up mandrel into the shoulder-shaped recess.

In that the cup sleeve material is drawn into the recess during forming of the circumferential projection, the material is prevented from being stretched. In fact, the sleeve material is compressed in sections by means of the forming of the shoulder, so that indeed a reinforcing of the material can be achieved.

In a further embodiment of the present invention, the take-up mandrel is designed conically and the shoulder-shaped recess graduates towards the thinner end of the take-up mandrel into the conical base area of the take-up mandrel again, whereby the cup sleeve is shortened in an area located between the recess and an upper thicker end of the take-up mandrel during the forming of the circumferential projection.

This shortening of the cup sleeve is caused by the drawing in or yielding of the sleeve material into the recess and results in the prevention of a weakening of the sleeve material during the forming of the circumferential projection.

In a further embodiment of the invention, the application of a bottom to the cup sleeve takes place before the forming of the circumferential projection.

In a further embodiment of the present invention the forming of a lip on the upper end of the cup sleeve opposite the bottom end, takes place before the forming of the circumferential projection.

In this way the cup sleeve can be stabilized before the application of the circumferential projection by applying a bottom and a lip. This prevents the yielding movement or the drawing in movement of the sleeve material during the forming of the circumferential projection from causing a deformation of the sleeve form.

BRIEF DESCRIPTION OF THE DRAWINGS

These and further objects, features and advantages of the present invention will become more readily apparent from the following detailed description of an advantageous embodiment when taken in conjunction with the accompanying drawings wherein.

DETAILED DESCRIPTION OF THE DRAWINGS

Figure 1:
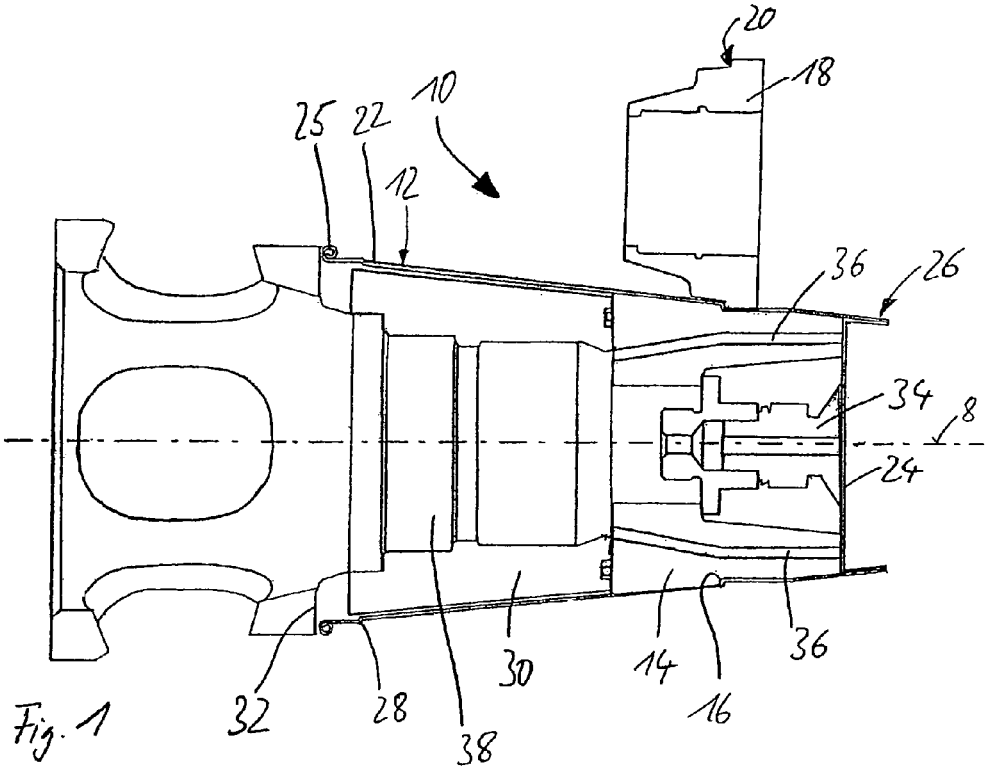
FIG. 1 shows a schematic depiction of a device for the production of paper cups according to the present invention.

In the schematic side view of FIG. 1 a device 10 according to the present invention for the production of a paper cup 12 is shown. The device 10 comprises a take-up mandrel 14 having a conical base form, said take-up mandrel 14 being provided with a circumferential recess 16 in the form of a shoulder. This circumferential recess 16 extends from the imaginary, continuous conical base area of the take-up mandrel 14 in the direction towards the middle longitudinal axis of the take-up mandrel 14. The device 10 comprises further a press roller 18, which supports a circumferential shoulder 20. Subsequent to the paper cup 12 being slid onto the take-up mandrel 14, the press roller 18 is placed on the outer surface of the paper cup 12 above the recess 16. Subsequent to the press roller 18 being pressed onto the take-up mandrel 14 or on the paper cup 12, a shoulder corresponding approximately to the recess 16 is formed in the paper cup 12. The press roller 18 is moved around the entire circumference of the take-up mandrel 14 in that for example the take-up mandrel 14 is rotated, in order to form a circumferential shoulder in the paper cup 12.

The paper cup 12 comprises a cup sleeve 22 and a lip 25 formed onto the upper edge, shown on the left hand side in FIG. 1, said paper cup 12 being furthermore provided with a bottom 24, which is joined by means of a circumferential skirt 26 to the lower edge of the cup sleeve 22, shown in FIG. 1 on the right hand side.

The paper cup 12 is provided for sliding on an outer sleeve in order to produce a double-walled paper cup. Just below the lip 25, the paper cup 12 comprises for this reason a circumferential shoulder 28 which projects inwards into the inner space of the cup sleeve 22. The outer sleeve is attached to the cup sleeve 22 between the lip 25 and the shoulder 28, while below the shoulder 28 an insulating intermediate space is provided between the outer sleeve and the cup sleeve 22. The outer sleeve comprises a curled-in part at its lower end, which curled-in part can be applied for the purposes of stacking. A corresponding design for an outer sleeve is disclosed for example in European published patent application EP 1 227 943 A1.

The device 10 comprises further an extension 30 of the take-up mandrel 14, whereby the extension 30 also comprises a conical base form, while the paper cup 12 is not disposed on the outer circumference of the extension 30. The extension 30 also comprises a circumferential supporting surface 32, on which the lip 25 of the paper cup 12 can be positioned in order to define exactly the position of the cup 12 in the device 10. When the circumferential projection is formed by means of the press roller 18 and the recess 16 in the take-up mandrel 14, the cup sleeve 22 is shortened in the area between the recess 16 and the lip 25, so that the lip 25 is moved a short distance away from the stopping surface 32.

In the interior of the take-up mandrel 14, a suction and expulsion device 34 is provided, by means of which the bottom 24 can be held by suction. The take-up mandrel 14 itself is provided with suction channels 36, which, during the rolling-in process of the circumferential projection, also reliably hold the bottom 24 and in so doing also the cup sleeve 22 which is attached in a fixed way to the bottom 24 by means of the skirt 26. The suction and expulsion device 34 can furthermore be moved to the right in relation to the take-up mandrel 14 as shown in FIG. 1, in order to remove the finished paper cup 12 from the take-up mandrel 14 again.

The extension 30 comprises a central borehole 38, which is subject to low pressure during the rolling-in of the circumferential projection. The suction channels 36 and a suction channel in the suction and expulsion device 34 are in a flow connection with the channel 38 and thus suck in the bottom 24. Subsequent to the rolling in of the circumferential projection, the channel 38 is ventilated so that the suction and expulsion device 34 can lift the paper cup 12 from the take-up mandrel 14, in that it is moved to the right as shown in FIG. 1 by means of activating rods (not shown). A separate conduit for the suction and expulsion device 34 can be provided in order that the bottom 24 can be held by suction even during expulsion.

Figure 2:
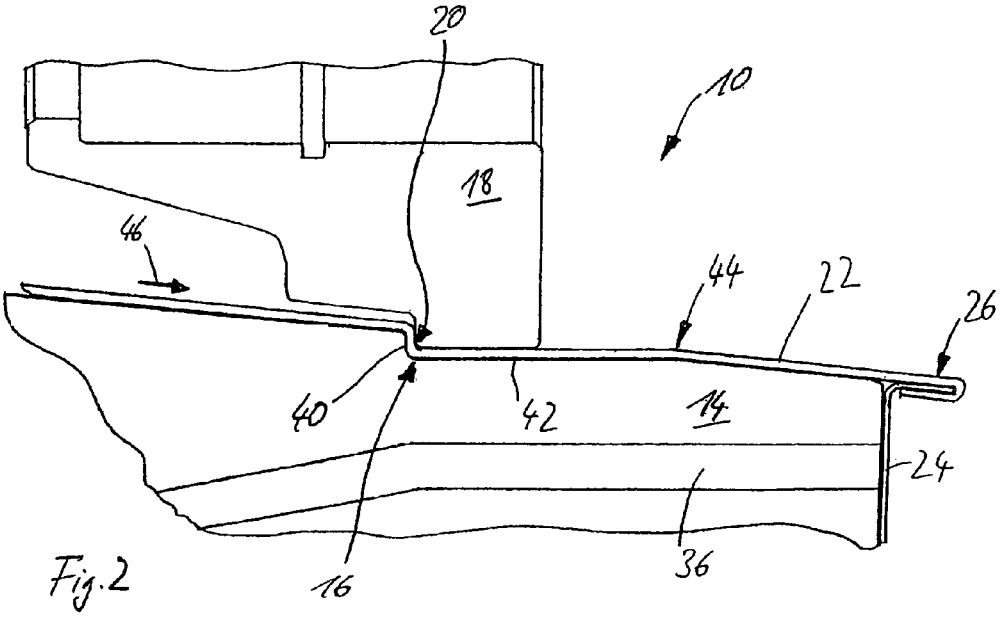
FIG. 2 shows in sections an enlarged view of the device in FIG. 1.

FIG. 2 shows the device 10 of FIG. 1 in sections and in enlarged dimensions. The press roller 18 and its circumferential shoulder 20 can be easily recognized, said shoulder 20 being adapted to the shoulder-shaped recess 16 in the take-up mandrel 14. The recess 16 comprises a shoulder face 40 and a shoulder area 42, whereby the shoulder face 40 is arranged perpendicular to the middle longitudinal axis of the take-up mandrel 14. The shoulder area 42 in contrast extends parallel to the middle longitudinal axis of the take-up mandrel 14. The recess 16 extends, beginning from an imaginary, conical base area of the take-up mandrel 14 in the direction towards the middle longitudinal axis of same. The shoulder face 40 can, as shown, form an angle of 90° to the middle longitudinal axis, the shoulder face 40 can also be arranged at an angle between 45° and 90° towards the middle longitudinal axis, at an angle of less than 90° the diameter of the shoulder face 40 decreases in the direction towards the thinner end of the take-up mandrel 14, possesses then an identically aligned conicity as the base area of the take-up mandrel 14. In the shown embodiment, the shoulder area 42 forms an angle of 6° with an imaginary base area of the take-up mandrel 14 and extends parallel to the middle longitudinal axis. An angle between the imaginary conical base area of the take-up mandrel 14 and the shoulder area 42 forms an angle in any case of less than 45°, an angle of less than 20° relative to the middle longitudinal axis is advantageous.

It can be clearly seen in FIG. 2 that the material of the cup sleeve 22 is simply bent or folded during rolling in of the circumferential shoulder in an area 44, which lies in the crossover area between the shoulder area 42 and the conical outer surface of the take-up mandrel 14. As a result the cup sleeve 22 is not shortened in the area between the shoulder face 40 and the thinner right hand side (as shown in FIG. 2) end of the take-up mandrel 14 by the formation of the circumferential shoulder. The cup sleeve 22 and its attachment to the cup bottom 24 on the circumferential skirt 26 is not impaired by the formation of the circumferential shoulder.

At the recess 16 itself, the material of the cup sleeve 22 is drawn into the recess 16 in the direction of an arrow 46 by means of placing the press roller 16. As disclosed above, the lip 25, see FIG. 1, is drawn away to the right from the stopping surface 32 as a result. It is however essential that this drawing-in of the material of the cup sleeve 22 in the direction of arrow 46 does not cause the cup sleeve material to become stretched during the formation of the circumferential shoulder. As can be seen in FIG. 2, the thickness of the cup sleeve 22 also remains almost constant in the area of the recess 16. The circumferential shoulder can be formed without the material of the cup sleeve 22 being weakened. The circumferential shoulder can as a result project comparably far into the interior of the cup sleeve 22 and can be formed at a right angle to the middle longitudinal axis. Very good stacking properties can hereby be achieved. In forming the circumferential shoulder, the material of the cup sleeve 22 can even be slightly compressed in the crossover area between the shoulder face 40 and the shoulder area 42 and therefore reinforced.

In the production of a paper cup by means of the device 10 according to the present invention, the paper cup 12 can be previously provided with a bottom 24 and a lip 25, as disclosed above, as an attachment of the cup sleeve 22 to the bottom 24 in the area of the circumferential skirt 26 is not loaded during forming of the circumferential shoulder. Only the distance between the bottom 24 and the lip 25 is shortened.

Figure 3:
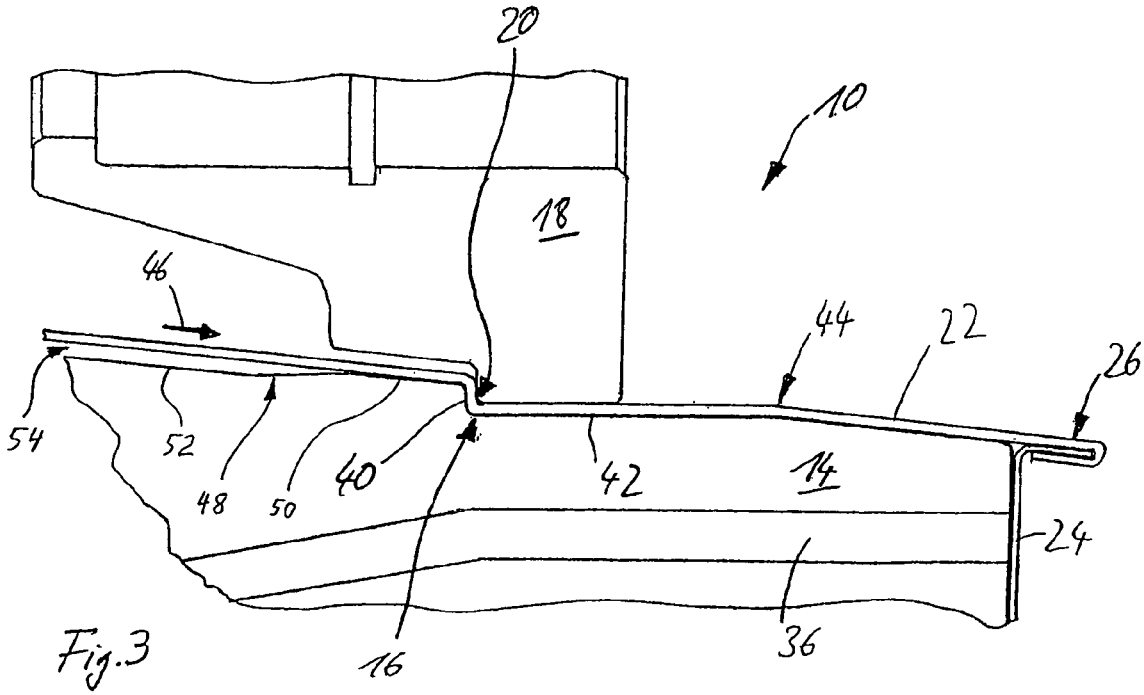
FIG. 3 shows a drawing similar to FIG. 2 of a variation of the device.

The depiction in FIG. 3 shows an advantageous variation of the device 10 of FIG. 2. The variation shown in FIG. 3 operates in the same way as the variation in FIG. 2. The same elements are provided with the same references. To avoid repetition, reference is made to the description above.

The take-up mandrel 14 in FIG. 3 comprises a second recess 48, which is at a distance to the circumferential recess 16 and which is arranged in the area of the thicker end of the take-up mandrel 14. An area 50 of the conical surface of the take-up mandrel 14 remains between the recess 16 and the recess 48. The area 50 adjoins the shoulder face 40 and supports the material of the cup sleeve 22 in yielding when the material is drawn into the recess 16. In order that the yielding of material of the cup sleeve 22, denoted by arrow 46, is not hindered by too much adherence to the conical surface of the take-up mandrel 14, the contact surface between the cup sleeve 22 and the take-up sleeve 14 is reduced by the recess 48. The recess 48 can be designed along the whole circumference in circumferential direction of the take-up mandrel 14. An advantageous distance of several tenths of a millimetre is provided between the base area 52 of the recess 48 and the cup sleeve 22. The gap 54 between the take-up mandrel 14 and the cup sleeve 22 can be continued by the gap shown in FIG. 1 between the extension 30 and the cup sleeve 22. It is sufficient for a good formation of the circumferential shoulder on the cup sleeve 22 when the area 50 comprises an axial length—as seen along the middle longitudinal axis of the take-up mandrel 14—of less than 10 millimetres, advantageously between 3 and 5 mm.

To ensure very reliable guiding of the cup sleeve 22 on the take-up mandrel 14, it can be provided that a number of recesses 48 are arranged along the circumference of the take-up mandrel 14, said recesses 48 being discontinued due to remaining areas of the conical circumferential surface of the take-up mandrel 14. Groove-like recesses 48 are advantageously designed so that the groove extends essentially parallel to the middle longitudinal axis of the take-up mandrel 14. The groove-like recesses 48 also reduce, due to the distance between the base area 52 and the material of the cup sleeve 22, the contact surface between take-up mandrel 14 and cup sleeve 22, and in doing so prevent the yield 46 from being impaired by too high a level of adherence between cup sleeve 22 and take-up mandrel 14.

The invention claimed is:

1. A device for manufacturing paper sleeves for production of paper cups comprising a take-up mandrel for taking up a sleeve, whereby the take-up mandrel comprises a circumferential recess, the device further comprising a rotatable press roller for placing on an outer side of the sleeve for moving around an entire circumference of the take-up mandrel by rolling on the outer side of the sleeve and for forming a circumferential projection in the sleeve by conforming the sleeve to the recess of the take-up mandrel, wherein the recess is designed in the form of a shoulder and wherein the take-up mandrel is designed to allow a shortening of the sleeve during formation of the circumferential projection.

2. The device according to claim 1, wherein a face of the shoulder forms an angle of between 45° and 90° with a middle longitudinal axis of the take-up mandrel and wherein a shoulder area extends parallel to the middle longitudinal axis or forms with same an angle of less than 20°.

3. The device according to claim 2, wherein the take-up mandrel has a conical base form, whereby the shoulder area extends, starting from the face, in a direction towards a thinner end of the take-up mandrel.

4. The device according to claim 1, wherein the take-up mandrel comprises at least one further recess which is spaced from the circumferential recess and which is arranged in an area of a thicker end of the take-up mandrel.

5. The device according to claim 1, wherein the press roller comprises a circumferential shoulder which corresponds to a shape of the recess in the take-up mandrel.

6. A process for production of a paper cup comprising:

forming a cup sleeve;

taking up the cup sleeve on an outer surface of a take-up mandrel, whereby the take-up mandrel is provided with a recess for forming a circumferential projection in the cup sleeve;

placing a rotatable press roller on the cup sleeve outside of the recess; and forming the circumferential projection, which projects into the recess of the take-up mandrel, by moving the press roller around an entire circumference of the take-up mandrel by rolling on an outer side of the sleeve;

wherein, during forming of the circumferential projection, the press roller draws in a part of material of the cup sleeve from the outer surface of the take-up mandrel into the recess, thereby shortening the cup sleeve.

7. The process according to claim 6, wherein the take-up mandrel is conically shaped and the recess graduates towards a thinner end of the take-up mandrel into a conical base area of the take-up mandrel and whereby the cup sleeve is shortened during the forming of the circumferential projection in an area located between the recess and an upper end of the take-up mandrel.

8. The process according to claim 6, further including applying a bottom to the cup sleeve prior to forming the circumferential projection.

9. The process according to claim 6, further including forming a lip on an upper end, opposite to a bottom, of the cup sleeve prior to forming the circumferential projection.

* * * * *